United States Patent [19]

Neshyba

[11] 4,401,169

[45] Aug. 30, 1983

[54] SYSTEM FOR LAGTIME MEASUREMENT DURING DRILLING

[76] Inventor: Valiant J. Neshyba, 3339 E. Bayou Dr., Dickinson, Tex. 77539

[21] Appl. No.: 292,270

[22] Filed: Aug. 12, 1981

[51] Int. Cl.[3] ..... E21B 47/00

[52] U.S. Cl. ..... 175/42; 175/48; 73/155; 206/0.5; 166/250

[58] Field of Search ..... 175/42, 48, 46, 38, 175/65, 40, 308, 309; 166/250, 63; 73/151, 155; 206/0.5, 495, 0.6, 805; 116/206

[56] References Cited

U.S. PATENT DOCUMENTS 2,414,246 1/1947 Smith ..... 175/48

3,155,176 11/1964 Bennett ..... 175/42

*Primary Examiner*—Ernest R. Purser

*Assistant Examiner*—Hoang C. Dang

*Attorney, Agent, or Firm*—Vaden, Eickenroht, Thompson, Bednar & Jamison

[57] ABSTRACT

A drop device, method and article of manufacture used in measuring lagtime in the drilling of a well. A unique container with calcium carbide is inserted upwardly by its guide end into the open end of a pin connection prior to its threaded assembly into a lower box connection on drill pipe. The container is handled by a resilient member during placement into the pin connection and secured in place by a loop on the resilient member. The container is formed in a right cone of thin sheet material and its tapered sides are waterproof, and a disc seals the bottom or floor of the cone. The container is held in the pin connection with the floor adjacent its lower end. The pin and box connections are assembled and resumed drilling fluid flow fragments and disperses the sheet material whereby the calcium carbide converts to acetylene that is readily detected in the outflowing drilling from the well.

13 Claims, 3 Drawing Figures

SYSTEM FOR LAGTIME MEASUREMENT DURING DRILLING

BACKGROUND OF THE INVENTION

This invention relates to measurements made relative to circulating drill fluid during the drilling of a well; and more particularly, it relates to a system for lagtime measurements concerning the returning drilling fluid.

DESCRIPTION OF PRIOR ART

During the drilling of a well, it is most important to collect samples of formations being penetrated by a drill bit rotated at the bottom of an extended length of drill string. Samples of formation cuttings are relatively easily taken from the outflowing drilling fluid usually at a shale shaker that separates solids from the drilling fluid.

One problem in taking these samples is in correlating a particular "rock" sample to the depth at which the formation resides that produced the sample. Obviously, there is a certain lagtime time required for the cuttings sample to travel upwardly in the well from the drill bit to the earth's surface. The "mud logger" usually has the responsibility to solve the correlation problem and collect proper samples. However, he is generally not a part of the drilling crew, and therefore, he is tolerated on the derrick floor only if no interference is made with the drilling operations.

In the past, the mug logger has tried to solve the lagtime problem by using a "carbide bomb." The bomb is simply a paper sack or other container that encloses a few ounces (e.g., 4 oz) of calcium carbide. Immediately prior to the derrick crew assemblying the next joint of drill pipe into the string, the mud logger makes a quarter back dash to the turntable where the drill pipe is held by "slips" with the open box connection yet overflowing by drilling fluid, i.e., mud. He pushes the bomb down into the mud and it hopefully stays in the box connection until the joint is threaded together. Unfortunately, the next pipe section is held by the hook from the traveling block with the pin connection only a few inches above the box connection. This pipe section may weigh a ton or more and it is swaying and bobbing directly above the box connection. The mud logger must be fast and careful even when being rushed by the driller, otherwise lowering the drill joint to thread the pin and box connectors could mangle exposed fingers etc. Naturally, the several derrick men on the drilling rig must be avoided in machinery cluttered 20 by 20 foot space by the mud loggers fast entry, fast bomb stuffing and faster exit from the turn table area. Many times the bomb is flushed from the box connection by backflowing drilling fluid. As a result of this event, or premature release of acetylene gas, the mud logger in a cloud of acetylene gas becomes a persona non-grata to the rig crew.

Assuming the pin and box connection is assembled with the bomb in place, the resumed downflow of drilling fluid pushes the bomb down the drill string. At this point, the water components of the drilling mud enter the bomb and convert the calcium carbide to acetylene gas. Continued circulation of the drilling fluid moves the acetylene gas through the drill bit and then the gas returns in the well annulus to the earth's surface. The acetylene gas can be readily detected at the shale shaker by conventional instruments, such as gas, explosion or hydrocarbon detectors.

The mud logger calculates the lagtime it takes cuttings to travel from the drill bit to the shale shaker by subtracting from the total time of acetylene gas travel (bomb insertion to shale shaker) the time the bomb travels from the box connection at the turn table to the drill bit (a function of drilling fluid flow rate and volumetric capacity of the drill pipe). Thus, if the lagtime is "x" minutes, the rock samples from a given formation appear at the shale shaker this "x" minutes later in time. Therefore, the mud logger can correlate a rock sample to a certain formation.

As the well becomes deeper, the lagtime determination becomes increasingly more important and also increases in magnitude. Another use of the lagtime measurement by the bomb technique relates to checking the functioning of gas detection equipment, to determine borehole uniformity, presence of formation washout conditions and identify pressure indicators. In a deep well, e.g., 15,000 feet, the drilling operation is very expensive and critical to control for safe and effective drilling results. A correct lagtime determination becomes critical and is the foundation of the penultimate decision-a production well or cement and abandonment.

The present invention is a system, including a drop device, method of use and manufactured article so that the mud logger can easily and safely place the "carbide bomb" into the pin connection of the hanging pipe joint and secure it in place without risking his safety or premature release of the acetylene gas.

SUMMARY OF THE INVENTION

In accordance with this invention, there is provided a system for making determinations (i.e., lagtime) in a drilling fluid at dynamic circulating conditions during the drilling of a well with a fluid circulating bit on a drill pipe having pin and box connections. A drop container is provided of sheet material having a guide end, nonporous sides and an enclosing floor. The container encloses an indicator material which reacts with drilling fluid to produce a readily detectable gas (e.g., acetylene).

Preferably, the container is water proof paper formed into a right cone with a disc sealing the bottom or floor. An elastic elongated resilient member is secured at the floor and includes a loop adapted to be slipped over the threaded end of the hanging pipe joint. The user grasps the resilient member and slips the loop over the end of the hanging pipe while inserting the guide end upwardly into the threaded end (usually the pin connection). Releasing the manual tension on the resilient member secures the container in place on the pipe. Assembly of the pin and box connection severs the resilient member and circulation of drilling fluid moves the container towards the drill bit. The container preferably is made of sheet material that is fragmented and dispersed by the drilling fluid flow or passage through the drill bit, or both conditions.

A drop device made of a right cone of water proof paper sealed by a paper disc and containing calcium carbide provides good results in determining lagtime in circulating drilling fluid in a well.

DESCRIPTION OF THE DRAWINGS

In these drawings, the several embodiments have common elements of construction in the drop device. In regard to the several figures, like elements carry like numerals to simplify description of the present system.

DESCRIPTION OF PREFERRED EMBODIMENTS

Figure 1:
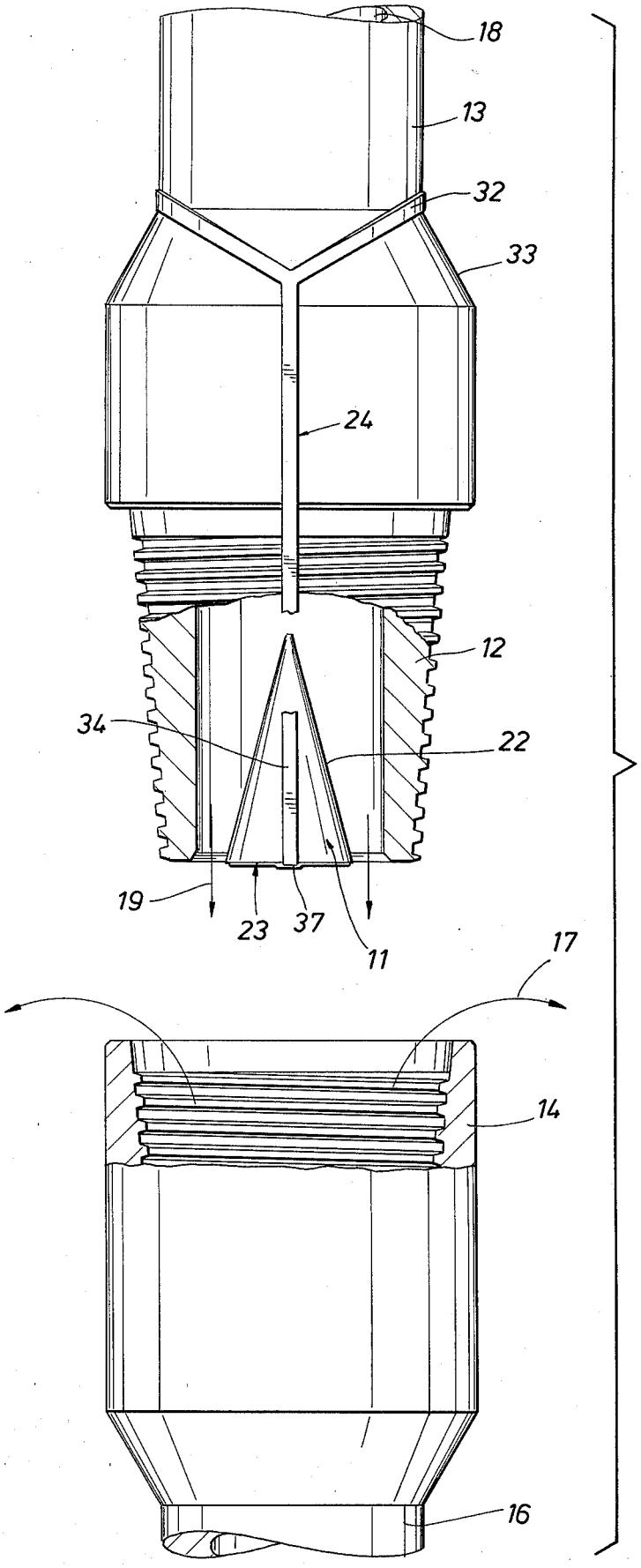
FIG. 1 is a perspective, partially sectional, showing the drop device positioned in a pin connection of drill string according to the present invention.

Referring to FIG. 1, there is shown the drop device used in the system of this invention in a conventional rotary drilling operation. The drop device 11 is shown immediately after installation within a pin connection 12 carried at the lower end of a pipe 13 that may be suspended from the hook of the traveling block on a drilling rig.

The pipe 13 is positioned above but spaced a few inches from the pipe 16 in the turn table forming part of the drill string in the well used with a down hole drilling bit which penetrates the subterranean formations. The pipe 13 is now lowered to interengage the box connection 14 on the pipe 16. Rotation of the pipe 13 treads the pin and box connections together. At this time, downward circulation of drilling fluid in the drill string is resumed with the drilling operation. The drilling fluid travels the flow passage 18 and lastly exits the bit and returns with cuttings in the well annulus to the earth's surface where it is treated in shale shakers desander, desilters and other mud processing machinery. Samples of cuttings are readily secured at the first shaker.

Usually, there is a back flow of drilling fluid, as indicated by arrows 17, from the box connection 14. Also, water and small amounts of drilling fluid may dribble from the pin connection 12 as shown by arrows 19. If the prior art carbide bomb were stuffed onto the box connection 14, the mud backflow or downflow 19 could either dislodge it or prematurely convert it into explosive acetylene gas.

The drop device 11 is arranged to avoid these problems with the prior art carbide bomb and provide a complete safe installation in both method and structure for the mud logger, and reduce any interference to the drilling crew. All of these unique results are obtained while providing for an accurate determination of lag-time in the well.

Figure 2:
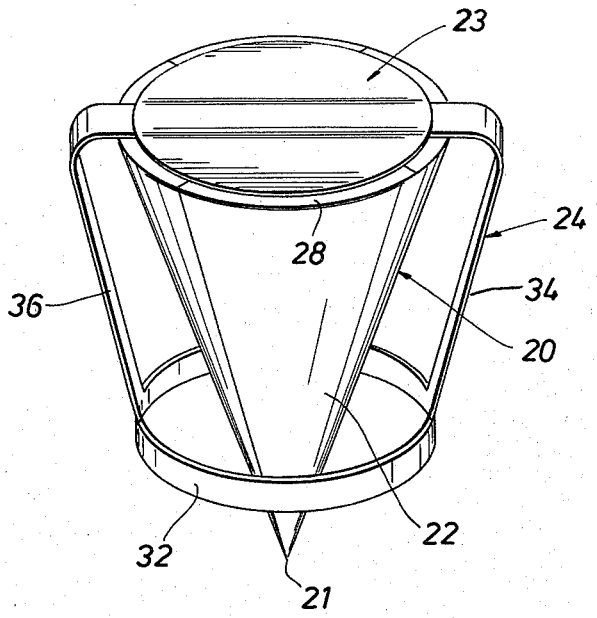
FIG. 2 is a perspective with the drop device inverted to illustrate its construction.
Figure 3:
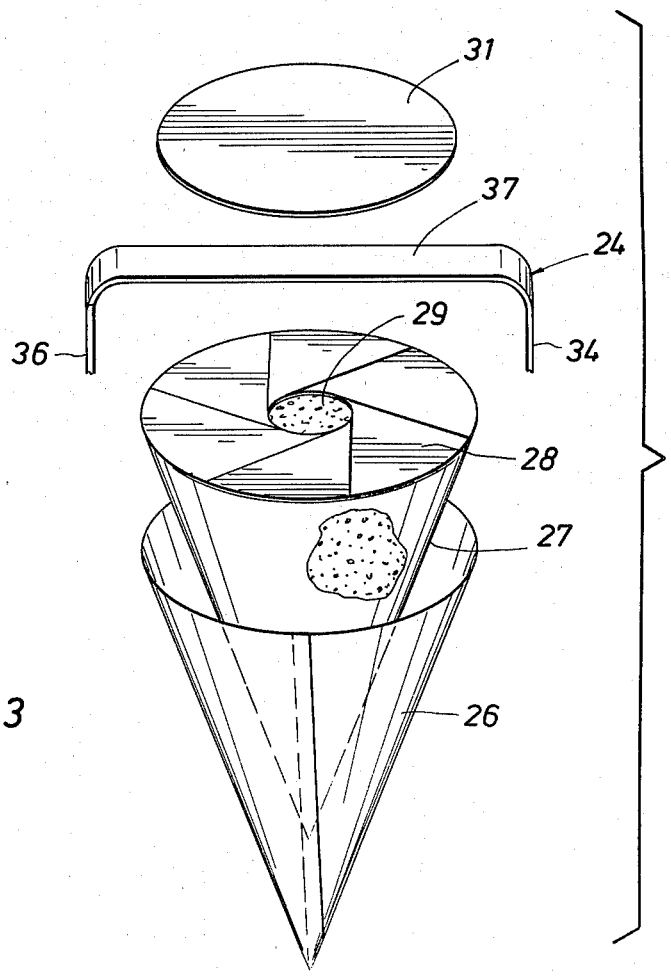
FIG. 3 is an expanded element view illustrating the several components of the drop device.

As seen in FIGS. 2 and 3, the drop device 11 is formed integrally in a container 20 with a guide end 21, non-porous sides 22 and a base or floor 23, and a resilient member or bond 24.

Preferably, the drop device 11 is constructed into the form of a right cone with the floor 23 being a disc that is secured as by adhesives to the tapered sides 22.

The container 20 can be constructed of suitable thin sheet material such as paper. The sheet material is treated in manufacture or later so that it fragments and disperses during traveling through the drill string and out of the drill bit. Although the container should be constructed of any suitable sheet material, good results are obtained using several different paper sheet materials.

For example, the container 20 has an outer cone member 26 that prevents permeation of drilling fluid. A waxed paper construction of the cone member 26 gives excellent results with water based drilling fluids. An inner cone member 27 is positioned and secured within the cone member 26. The member 27 can be of a suitable sheet material, such as thin paper that does not have to be waterproofed.

The cone member 27 is end closed by interleafing a plurality of flaps 28. The flaps 28 may leave exposed some of the indicator material 29 that fills the container 20. The flaps 28 are sealed and secured by the disc 31 which may also be untreated or unwaxed paper and to the cone 26.

Any indicator material 29 (liquid or solid) can be used that goes into a gas state upon direct contact and reaction with a component of the drilling fluid. Usually, the indicating material 29 will include calcium carbide that reacts with water in drilling fluids to produce the readily detected acetylene gas.

The container 20 is handled and positioned in the pin connection 12 by using the band 24 in a manner to prevent placing the users hands between pin and box connection where digit severence and other injury can occur so suddenly and disastorously. For this purpose the band 24 is formed from an elongated elastic strip such as natural or synthetic rubber. Preferably, the band 24 is molded in one piece but it can be formed of several pieces integrally joined by adhesives or other mechanical arrangements.

The band 24 has an enclosed loop 32 that is adapted to be stretched about the pin connection 12 and released to securely grip the exterior of the pipe 13. Where the pin connection 12 is of the external upset type, the loop 32 should be secured above the shoulders 33.

The band 24 has strap parts 34 and 36 extending from the loop 32. The strap parts 34 and 36 are preferably of equal lengths and part of a continuous strip which include strap part 37 that is secured between the disc 31 and the cone members 26 and 27.

The band 24 has a thickness and width as an elastic member of insignificant structure so that it doesn't interfere in properly threading together of the pin and box connections. Threading these connections together severs strap parts 34 and 36 releasing the container 20 within the passageway 18.

The drop device 11 may have varied amounts of the indicating material 29 but good results have been obtained using between 4 and 8 ounces of calcium carbide.

The installation of the drop device 11 is safe and easy even to a fast moving mud logger on a crowded drilling floor. When the driller has picked up the pipe 13 (e.g. ninety feet in length) and holds the pin connection 12 a few inches above the box connection 14, the drop device 11 is held by the strap parts 34 and 36 with hands spread apart to clear the threaded connection. At the same time, the loop 32 is spread open sufficiently to pass over the pin connection onto the pipe 13. Now, the container 20 is inserted upwardly into the passageway 18 with the guide end 21 entering first into the pin connection 12. The loop 32 is released to secure the container 20 in the pin connection with the floor 23 being flush with the lower end of the pipe 13.

If any water or drilling fluid 19 flows onto the container 20, the waterproof cone 26 protects the indicator material from premature conversion into the gas state.

Upon threaded assembly of the pin and box connections, the container 20 is free to move with the drilling fluid in passageway 18.

Circulation of drilling fluid through the passage 18 usually will open the container 20 and convert the indicator material 29 into the gas state. However, the gas remains much like a bubble and travels committantly with the drilling fluid. In any event, passage of any remaining container through the drill bit produces total conversion of the indicator material 29 into the gas state by exposure thereof to the activating components of the drilling fluid.

The time when circulation is resumed is noted as is the time the gas appears at the shale shaker in the outflowing drilling fluid from the well. The time required for the drop device 11 (or its products) to travel downhole in the passage 18 to the drill bit is calculated by dividing the volumetric capacity of the drill string by the volumetric inflow of the drilling fluid. The difference between the total time in passage of the drop device and its gas produce is reduced by the downhole travel time to give accurately the lagtime in drilling fluid circulating in the well annulus from the drill bit to the shale shakers. As a result, the mud logger can determine exactly the correlation between a formation at a certain depth to cuttings from that formation arriving at the shale shaker. Other conditions associated with the circulating drilling fluid can also be determined by the use of the drop device 11.

In water based or containing muds, the indicator material will usually be calcium carbide and the resulting gas is acetylene. However, metallic sodium pellets can be used which produce readily detectable hydrogen gas, and many oil based muds have sufficient alcoholic hydroxyl compounds to release the hydrogen gas. Other gas forming materials, such as the effervescent sodium citrate which produces carbon dioxide upon reaction with water, can also be used. Generally, for any given drilling fluid, a suitable indicator material and construction of the container 20 can be employed following the present description.

From the foregoing, it will be apparent that the system of this invention has provided a unique drop device, a method of use, and an article of manufacture especially suited for the method to determine lagtime and in other cases where a detectable gas is desired. It will be appreciated that certain changes and alterations can be made in this system without departing from the spirit of this invention. These changes are contemplated by and are within the scope of the appended claims which define the invention. Additionally, th present description is intended to be taken as an illustration of this invention.

What is claimed is:

1. A device for making certain measurements in a drilling fluid at dynamic circulating conditions during the drilling of a well with a fluid circulating drill bit on a drill pipe having pin and box connections, the device comprising:

(a) a drop container of thin sheet material having a guide end, non-porous sides and an enclosing floor;

(b) said container carrying internally an indicator material converting from a stable state to a gas state upon direct contact with one or more components of the drilling fluid, (c) said guide end and said sides being resistant to passage of the activating components of the drilling fluid into direct contact with said indicator material; and (d) an elastic elongated resilient member mounted to said floor, and said resilient member including a loop adapted to be slipped over one of said pin and box connections for holding said container guide end upwardly within the flow passageway of said connection.

2. The device of claim 1 wherein said guide end connects with said sides which are tapered to said floor thereby forming a right cone.

3. The device of claim 2 wherein said guide end and tapered sides are constructed from a water impermeable sheet material.

4. The device of claim 3 wherein said indicator material is calcium carbide and said floor is a disc of sheet material secured to said right cone.

5. The device of claim 1 wherein said resilient member includes a circular enclosed loop from which on opposite sides extending straps and parts of the straps are secured to said enclosing floor.

6. The method for measuring lagtime in a drilling fluid at dynamic circulating conditions during the drilling of a well with a fluid circulating drill bit on a drill pipe having pin and box connections, the steps comprising;

(a) securing the pipe with an upstanding box connection within the well;

(b) positioning a pin connection immediately above, but spaced slightly from the upstanding box connection;

(c) inserting and securing a cone-like container with its apex upwardly into the flow passageway of the pin connection and the container residing substantially within the pin connection by encircling a loop of elastic elongated resilient material about the pin connection with the container also secured to the resilient material;

(d) assembling threadedly the pin and box connections;

(e) flowing drilling fluid downwardly through the flow passageway of the drill pipe whereby an indicator material in said container is converted into a gas state by reaction with one or more components of the drilling fluid, (f) detecting the arrival of the gas from the indicator material at the outflowing drilling fluid, and (g) correlating the time required for arrival of the gas in the outflowing mud to the volumetric capacity of the well and to the volumetric inflow of the drilling fluid into the drill pipe for determining the lagtime in the drilling fluid.

7. The method of claim 6 wherein said indicator material is calcium carbide activated by aqueous components in the drilling fluid into the acetylene gas detectable in the outflowing drilling fluid.

8. The method of claim 7 said container has tapered sidewalls formed of water impermeable sheet material and enclosed by a disc of sheet material.

9. The method of claim 8 wherein the resilient material includes a circular loop from which on opposite sides extends straps which have ends secured to the disc, and said container is positioned manually within the pin connection by grapsing said straps to each side of the disc without exposing human parts to injury between the pin and box connections.

10. A carbide drop device for lagtime measurements in a drilling fluid at dynamic circulating conditions during the drilling of a well with a fluid circulating drill bit on a drill pipe having pin and box connections, the device comprising:

(a) a container formed of thin sheet-like material with a guide end, tapering sides and an enclosing floor, and said sheet-like material being fragmented and dispersed by passage through the flow passageways of the drill pipe and bit;

(b) said container at its guide end and tapered sides being resistant to passage of water components of the drilling fluid and adapted to be inserted into the fluid passageway of the pin connection;

(c) said container enclosing an indicator material including calcium carbide reacting with the water components to produce a gas including acetylene that is readily detected in the outflowing drilling fluid from the well; and (d) an elastic elongated resilient member mounted onto said container, and said resilient member including a circular enclosed loop adapted in stretched condition to be slipped upon the pin connection and secured thereto in contracted condition; and equal length straps extending from opposite sides of the loop with the ends of the straps secured to the container adjacent said floor.

11. The container of claim 10 wherein the guide member end and tapering sides are of a water proof sheet material formed into a right cone and a disc of sheet material is integrally secured across the base of the cone.

12. The container of claim 11 wherein said indicating material is enclosed in a right cone formed of sheet material having an interleafed folded end covering, and said right cone containing indicating material is snugly received within said container and secured by said disc.

13. The container of claim 10 wherein parts of the straps are secured across said floor.

* * * * *